US006009826A

United States Patent [19]

Nole

[11] Patent Number: 6,009,826

[45] Date of Patent: Jan. 4, 2000

[54] BOAT ANCHOR WITH SNAG RELEASE MECHANISM

[76] Inventor: Richard M. Nole, 6302 U.S. Hwy. 41 S., Lot 241, Palmetto, Fla. 34221

[21] Appl. No.: 09/337,427

[22] Filed: Jun. 21, 1999

[51] Int. Cl.[7] ..... B63B 21/46

[52] U.S. Cl. ..... 114/299; 114/297

[58] Field of Search ..... 114/294, 297–299, 114/301–310

[56] References Cited

U.S. PATENT DOCUMENTS

| | | |
|---|---|---|
| 2,568,006 | 9/1951 | Illsche . |
| 2,764,116 | 9/1956 | Brewer . |
| 2,816,522 | 12/1957 | Root . |
| 3,150,629 | 9/1964 | Fields . |
| 3,841,255 | 10/1974 | Mansfield . |
| 4,098,217 | 7/1978 | Altman . |
| 4,386,575 | 6/1983 | Brown . |
| 4,721,054 | 1/1988 | Kobayashi . |
| 4,848,261 | 7/1989 | Kobayashi . |
| 4,951,593 | 8/1990 | Brown et al. . |
| 5,074,235 | 12/1991 | Kobayashi . |

FOREIGN PATENT DOCUMENTS

| | | | |
|---|---|---|---|
| 0190597 | 7/1989 | Japan | 114/297 |
| 1556998 | 4/1990 | U.S.S.R. | 114/297 |

*Primary Examiner*—Ed Swinehart
*Attorney, Agent, or Firm*—Charles J. Prescott

[57] ABSTRACT

A boat anchor and a retrieving mechanism for unsnagging the anchor from an underwater obstruction. The anchor includes an anchor body and a shank pivotally connected to the anchor body. The retrieving mechanism includes an elongated shank line connected between the crown and one end of an elongated clampbolt of an adjustable release mechanism. A clampbolt receiving block having a U-shaped channel is connected to a distal end of the shank which is aligned longitudinally to the shank and opening away from the anchor body. An enlarged shoulder of the clampbolt abuts against one end surface of the receiving block while an elastomeric friction member and a hand nut are positioned on a threaded portion of the clampbolt against the other end surface of the receiving block. The hand nut is tightenable against the friction member to selectively vary the lateral force required to disengage the release mechanism from the clamp block as applied by the anchor line when pulled somewhat orthogonally to the shank when the anchor body becomes snagged. When the release mechanism is disengaged, upward anchor line lifting force shifts to being applied directly to the crown to effect anchor unsnagging.

3 Claims, 2 Drawing Sheets

BOAT ANCHOR WITH SNAG RELEASE MECHANISM

BACKGROUND OF THE INVENTION

1. Scope of Invention

This invention relates generally to boat and ship anchors, and more particularly to an anchor having a release mechanism facilitating disengagement of the anchor from an underwater snag.

2. Prior Art

An anchor line attached to the free, distal end of an elongated shank of an anchor is normally all that is required to raise and lower an anchor from a boat under normal operating conditions. However, should the flukes of the anchor become fouled or snagged by a bottom obstruction, continued pulling of the anchor line from the boat will many times result in increasing the hold the anchor has on the obstruction. In such cases, the anchor is simply abandoned by cutting the anchor line.

It has become well known that anchors fouled on a bottom obstruction, however, can be released in many cases if the lifting force on the anchor line is temporarily transferred from the distal end of the shank to the crown of the anchor, the effect of which is to upset the anchor and thereby cause the flukes to be withdrawn from the engaging obstruction. The following prior art patented inventions are known to applicant which are generally directed to implementing the above anchor dislodgment technique:

U.S. Pat. No. 2,568,006 to Illsche

U.S. Pat. No. 2,764,116 to Brewer

U.S. Pat. No. 2,816,522 to Root

U.S. Pat. No. 3,150,629 to Fields

U.S. Pat. No. 3,841,255 to Mansfield

U.S. Pat. No. 4,098,217 to Altman

U.S. Pat. No. 4,386,575 to Brown

U.S. Pat. No. 4,721,054 to Kobayashi

U.S. Pat. No. 4,848,261 to Kobayashi

U.S. Pat. No. 4,951,593 to Brown et al.

U.S. Pat. No. 5,074,235 to Kobayashi

Regarding some of the above prior art references in more detail, the Brewer '116 patent discloses a retrieving means and boat anchor which are somewhat similar in principal to that of the present invention. In this patent disclosure, a unique link and latch arrangement are there shown wherein disengagement therebetween is accomplished when a lateral upward force is applied to the distal end of the shank from the anchor line when the boat is directly over the snagged anchor. Thereafter, once the release mechanism is overcome and separated from the shank, the anchor line will apply a generally vertical force to the crown of the anchor to effect anchor dislodgment.

In the '006 patent invented by Illsche, another closely related means for releasing a fouled anchor is there disclosed. This invention depends upon an adjustable level of friction retention at the distal end of the shank which must be overcome by laterally pulling thereon which the anchor line in a somewhat angular orientation to the shank of the anchor. After disengagement of the releasing mechanism, the anchor line then acts directly upon the crown of the anchor to effect disengagement.

Others of the above references likewise each include unique release mechanisms to accomplish the desired effect of applying anchor line lifting forces directly to the crown of the anchor and upward or forwardly fashion with respect to the snagged anchor. However, factors of complexity, cost and effective normal anchor use appear to be detractions from these prior art systems.

The present invention, primarily applicable to asymmetric anchors having the crown of the anchor offset in one direction from the axis of the shank and having a fluke which acts in ground engaging fashion only when the shank lies above the fluke, provides a unique and easily adjustable and reengageable release mechanism which, when pulled on by the anchor line in a direction substantially orthogonally to the longitudinal shank axis, will overcome the frictional retention force at the distal end of the shank to effect disengagement of the release mechanism so that further anchor line forces will be applied directly to the crown of the anchor to effect its dislodgment from the bottom snag or obstruction.

The present invention does not interfere with full normal use of the asymmetrical-type anchor when the release mechanism is properly engaged and tightened to a preselected frictional tightness of this releasable connection.

BRIEF SUMMARY OF THE INVENTION

This invention is directed to a boat anchor and a retrieving mechanism for unsnagging the anchor from an underwater obstruction. The anchor includes an anchor body and a shank pivotally connected to the anchor body. The retrieving mechanism includes an elongated shank line connected between the crown and one end of an elongated clampbolt of an adjustable release mechanism. A clampbolt receiving block having a U-shaped channel is connected to a distal end of the shank which is aligned longitudinally to the shank and opening away from the anchor body. An enlarged shoulder of the clampbolt abuts against one end surface of the receiving block while an elastomeric friction member and a hand nut are positioned on a threaded portion of the clampbolt against the other end surface of the receiving block. The hand nut is tightenable against the friction member to selectively vary the lateral force required to disengage the release mechanism from the clamp block as applied by the anchor line when pulled somewhat orthogonally to the shank when the anchor body becomes snagged. When the release mechanism is disengaged, upward anchor line lifting force shifts to being applied directly to the crown to effect anchor unsnagging.

It is therefore an object of this invention to provide an improved asymmetrical-type anchor with a fully adjustable release mechanism disposed at the distal end of the anchor shank which disengages at any preselected frictional level and associated anchor line force level when the anchor becomes snagged or permanently engaged to a bottom obstruction to facilitate the release and withdrawal of the anchor.

It is another object of this invention to provide a unique release mechanism for effecting dislodgment of snagged anchors which is easily adjustable and reengageable for normal anchor use and economical to manufacturer reliability.

In accordance with these and other objects which will become apparent hereinafter, the instant invention will now be described with reference to the accompanying drawings.

DETAILED DESCRIPTION OF THE INVENTION

Figure 1:
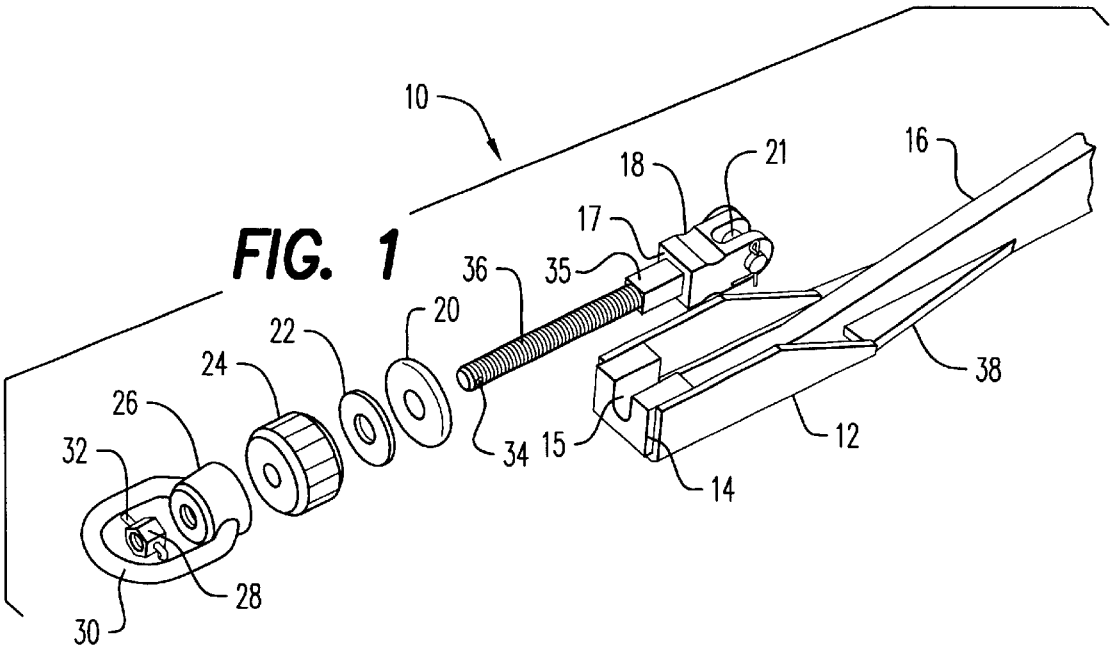
FIG. 1 is an exploded perspective view of the release mechanism and the distal end of the shank of the anchor.
Figure 2:
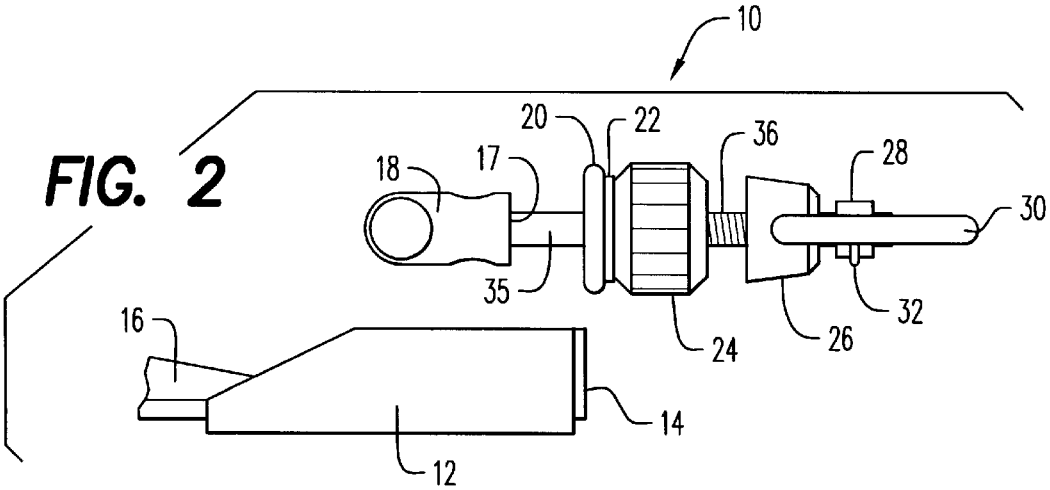
FIG. 2 is a side elevation view of FIG. 1 showing the release mechanism assembled.
Figure 3:
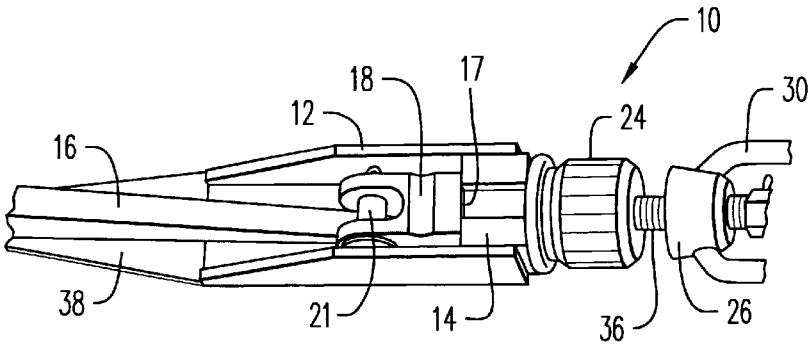
FIG. 3 is a perspective view of FIG. 2 showing the release mechanism fully engaged with the distal end of the anchor shank.

Referring now to the drawings, and firstly to FIGS. 1 to 3, the release mechanism itself is shown generally at numeral 10 and includes an elongated clampbolt 18 having threads 36 over a substantial portion thereof as shown. Disposed at one end of the clampbolt 18 is a clevis 21 which provides a connecting means with one end of a shank line 46 shown in FIGS. 4 through 7 as described herebelow.

Disposed at a distal end of the anchor shank 16 is a clampbolt receiving block 14 having a generally U-shaped receiving channel 15 formed longitudinally to the shank 16 and opening upwardly and transversely thereto. This channel 15 is sized in length and width to receive a square unthreaded portion 35 of the clampbolt 18. By making the lateral dimensions across the flats of the non-threaded portion 35 generally equal to the width of channel 15, when inserted together as shown in FIG. 3, relative rotation between the clampbolt 36 and the receiving block 14 and shank 16 are prevented to facilitate tension adjustment as described herebelow.

Side plates 12 and strengthening webs 38 are rigidly attached to the shank 16 for added strength in this region and for providing additional support both laterally and rotationally for the clampbolt 18 when the unthreaded square portion 35 is fully engaged within receiving channel 15 as best shown in FIG. 3. The shoulder 17 of clevis 18 abuts against one end surface of the receiving block 14 as best seen in FIG. 3.

The general purpose of the retaining mechanism 10 is to provide a strong selectively variable resistance to disengagement of the clampbolt 36 and clevis 18 disposed at one end thereof from the receiving block 14. To accomplish this, a disc-shaped friction member 20 formed of elastomeric material or other somewhat compressible material having a textured, non-slippery surface is provided which includes an aperture for slidable engagement onto the threaded portion 36 of the clampbolt 18. The unthreaded square portion 35 is generally equal in length or slightly shorter than that of the U-shaped channel 15 so that the friction member 20 will engage against the other end surface of the receiving block 14 as seen in FIG. 3. A rigid washer 22 is positioned on threaded portion 36 against the opposite surface of the friction member 20, followed by a large hand tightenable nut 24. By tightening the hand nut 24 against rigid washer 22 and friction member 20, pressure between the friction member 20 and the corresponding end surface of receiving block 14 is selectively increased.

An anchor link member 26 having a rigid loop 30 facilitates interconnection thereof with a distal end of the anchor line A as shown in FIGS. 4 to 7. After sliding the anchor link member 26 onto the threaded portion 36, a retaining nut 28 is threadably engaged thereon and pinned in place by cross pin 32 into cross hole 34 of the threaded portion 36 to retain the entire arrangement as best shown in FIGS. 2 and 3.

Referring additionally to FIGS. 4 to 7, the anchor, including the release mechanism 10 is shown generally at numeral 40. The proximal end of the shank 16 is pivotally connected at 17 to an anchor body 42, generally referred to as the crown of the anchor 40. This invention is generally best suitable for asymmetrical anchors wherein the flukes 44 of the anchor body 42 are disposed in generally one radial direction from the length of longitudinal axis of the shank 16 so that, when properly ground engaged to stabilize a boat attached to the upper end of the anchor line A from movement, the flukes 44 rest atop or embedded into the bottom of the water with the shank 16 directly thereabove. The axis of the pivotal connection 17 is thus generally oriented in use in an upright orientation and generally transversely to the longitudinal axis of shank 16.

A shank line 46 preferably formed of chain link material or flexible cable and the like as suited, is connected at one end through aperture 48 to the crown of the anchor body 42. The shank line 46 is generally similar in length to the length of the shank 16 so as to position the clampbolt 18 against the receiving block 14 as previously described with the other end of the shank line 46 being attached to clevis 21.

Figure 4:
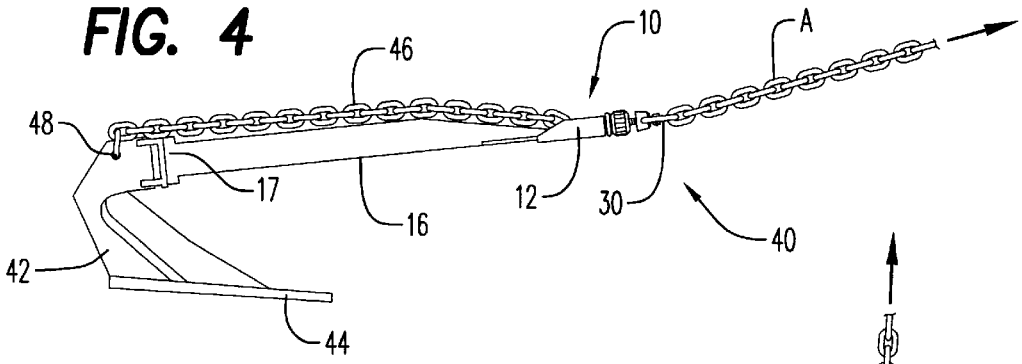
FIG. 4 is a side elevation view of the anchor and its release mechanism connected to an anchor line in normal use.

In normal use as shown in FIG. 4, the anchor assembly 40 will engage the bottom in a normal fashion and orientation shown with a sufficient amount of the anchor line A paid out from the boat attached to the other end of the anchor line A. Thus, the pulling load of the boat which is in the direction of the arrow at a normal anchor line scope or angle to the bottom will insure that the boat will not drag the anchor body 42.

Figure 5:
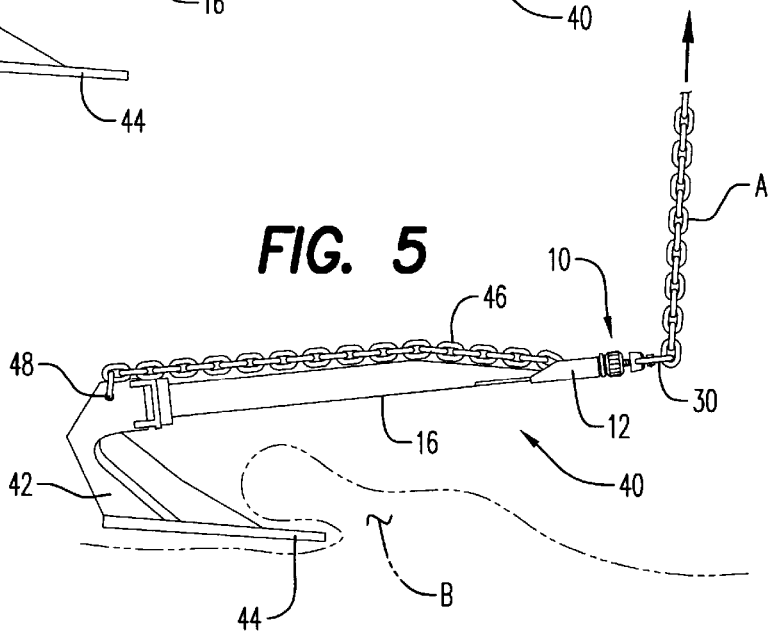
FIG. 5 is a view similar to FIG. 4 depicting a condition of anchor fluke obstruction engagement or snagging with the anchor line in an upwardly pulling orientation just prior to release mechanism disengagement.

However, as shown in FIG. 5, should one or more of the flukes 44 of the anchor body 42 become engaged in a bottom obstruction B, virtually no amount of anchor line load in the normal direction of the arrow of FIG. 4 will result in the anchor 40 being disengaged from the obstruction B.

Figure 6:
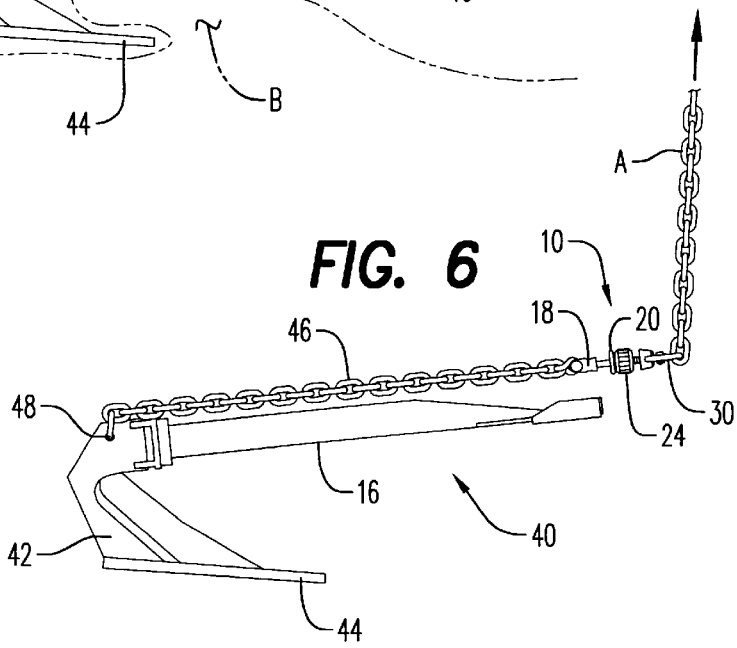
FIG. 6 is a view similar to FIG. 5 immediately after release mechanism disengagement.
Figure 7:
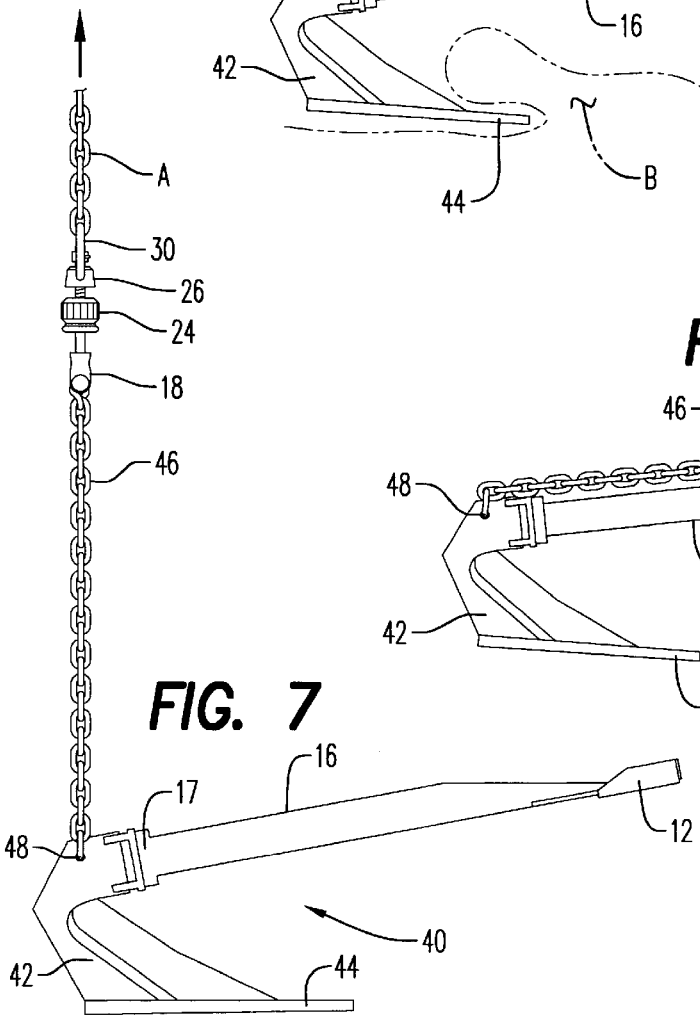
FIG. 7 is a view similar to FIG. 6 wherein the anchor line is exerting an upward anchor extraction force substantially upwardly from the crown of the anchor.

In such a case of anchor fouling or snagging, the boat operator will move the boat forward so that the anchor line is in a substantially upright orientation shown in FIG. 5. By additional anchor line pulling manually or by winch in the direction of the arrow, as seen in FIG. 6, the release mechanism 10 as above described will be disengaged upon the exertion of a force on the anchor line A sufficient to overcome the frictional force between the friction member 20 and the receiving block 14 to effect this disengagement. The level or amount of disengagement force exerted generally orthogonal to the length of the shank 16 is, as previously described, variable in proportion to the tightness of the hand nut 24 which increases the frictional resistance to movement between the frictional member 20 and the distal end face of the receiving block 14.

As soon as the release mechanism 10 has been overcome and disengaged as shown in FIG. 6, the anchor line A is drawn in to begin pulling directly upon the crown of the anchor body 42 at aperture 48. By increasing the pulling force on anchor line A either when the boat is directly above the anchor 40 or when the boat is moved forwardly of the anchor to cause the pulling of the anchor line A to provide a forwardly component upon the crown of the anchor body 42, disengagement from the obstruction is quickly effected without the need for any further retrieval operations or procedures or damage to the anchor or anchor line.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. In a boat anchor of an asymmetrical type having an anchor body with one or more flukes and an elongated shank pivotally connected at one end thereof to a crown of said anchor body about a substantially transverse pivotal axis between said shank and said anchor body, said anchor body and flukes extending and acting in ground engaging fashion in substantially one radial direction from said shank, an improved retrieving mechanism for retrieval of said anchor when at least one said fluke is snagged on an underwater obstruction comprising:

an elongated shank line connected at one end thereof to said crown and having a length in a range of that of said shank;

an adjustable release mechanism including an elongated clampbolt having a threaded portion extending from a distal end and over a substantial length thereof, another end of said clampbolt having a shank line clevis for connection thereof to another end of said shank line;

said release mechanism also including a clampbolt receiving block connected to a distal end of said shank and having first and second spaced generally parallel end surfaces and a generally U-shaped clampbolt receiving channel formed between said first and second end surfaces which receiving channel is aligned longitudinally to said shank and opening in an opposite direction from that of said anchor body and being adapted to receive a portion of said clampbolt, an enlarged shoulder of said clampbolt abutting against said first end surface of said receiving block;

said release mechanism further including a hand nut and a friction member, said friction member having a central aperture therethrough for slidable positioning thereof on said threaded portion against said second end surface of said receiving block, said hand nut threadably engaged on said threaded portion followed by an anchor link member held for swivel movement only adjacent said distal end of said clampbolt, said hand nut being tightenable against said friction member when said friction member is against said second end surface whereby a friction retaining force between said friction member and said second end surface is selectively varied to proportionately vary a lateral release force required to disengage said release mechanism from said clamp block by a substantially lateral force applied by an anchor line connected to said anchor link member;

said shank line and the anchor line becoming aligned one to another when said release mechanism is disengaged from said receiving block whereby upward anchor lifting force applied to the anchor line from a boat acts substantially upwardly from said crown to effect anchor unsnagging.

2. In a boat anchor of an asymmetrical type having an anchor body with one or more flukes and an elongated shank pivotally connected at one end thereof to a crown of said anchor body about a substantially transverse pivotal axis between said shank and said anchor body, said anchor body and flukes extending and acting in ground engaging fashion in substantially one radial direction from said shank, an improved retrieving mechanism for retrieval of said anchor when at least one said fluke is snagged on an underwater obstruction consisting essentially of:

an elongated shank line connected at one end thereof to said crown and having a length in a range of that of said shank;

an adjustable release mechanism including an elongated clampbolt having a threaded portion extending from a distal end and over a substantial length thereof, another end of said clampbolt having a shank line clevis for connection thereof to another end of said shank line;

said release mechanism also including a clampbolt receiving block connected to a distal end of said shank and having first and second spaced generally parallel end surfaces and a generally U-shaped clampbolt receiving channel formed between said first and second end surfaces which receiving channel is aligned longitudinally to said shank and opening in an opposite direction from that of said anchor body and being adapted to receive a portion of said clampbolt, an enlarged shoulder of said clampbolt abutting against said first end surface of said receiving block;

said release mechanism further including a hand nut and a friction member, said friction member having a central aperture therethrough for slidable positioning thereof on said threaded portion against said second end surface of said receiving block, said hand nut threadably engaged on said threaded portion followed by an anchor link member held for swivel movement only adjacent said distal end of said clampbolt, said hand nut being tightenable against said friction member when said friction member is against said second end surface whereby a friction retaining force between said friction member and said second end surface is selectively varied to proportionately vary a lateral release force required to disengage said release mechanism from said clamp block by a substantially lateral force applied by an anchor line connected to said anchor link member;

said shank line and the anchor line becoming aligned one to another when said release mechanism is disengaged from said receiving block whereby upward anchor lifting force applied to the anchor line from a boat acts substantially upwardly from said crown to effect anchor unsnagging.

3. In a boat anchor of an asymmetrical type having an anchor body with one or more flukes and an elongated shank pivotally connected at one end thereof to a crown of said anchor body about a substantially transverse pivotal axis between said shank and said anchor body, said anchor body and flukes extending and acting in ground engaging fashion in substantially one radial direction from said shank, an improved retrieving mechanism for retrieval of said anchor when at least one said fluke is snagged on an underwater obstruction comprising:

an elongated shank line connected at one end thereof to said crown and having a length in a range of that of said shank;

an adjustable release mechanism including:

an elongated clampbolt having a threaded portion extending from a distal end and over a substantial length thereof, another end of said clampbolt having a shank line clevis for connection thereof to another end of said shank line;

a clampbolt receiving block connected to a distal end of said shank and having first and second spaced generally parallel end surfaces and a generally U-shaped clampbolt receiving channel formed between said first and second end surfaces which receiving channel is aligned longitudinally to said shank and opening in an opposite direction from that of said anchor body and being adapted for receiving a portion of said clampbolt, an enlarged shoulder of said clampbolt abutting against said first end surface of said receiving block;

a hand nut and a friction member, said friction member having a central aperture therethrough for slidable positioning thereof on said threaded portion against said second end surface of said receiving block, said hand nut threadably engaged on said threaded portion followed by an anchor link member held for swivel movement only adjacent said distal end of said clampbolt, said hand nut being tightenable against said friction member when said friction member is against said second end surface whereby a friction retaining force between said friction member and said second end surface is selectively varied to proportionately vary a lateral release force required to overcome the friction force to disengage said release mechanism from said clamp block by a substantially lateral force applied by an anchor line connected to said anchor link member;

said shank line and the anchor line becoming aligned one to another when said release mechanism is disengaged from said receiving block whereby upward anchor lifting force applied to the anchor line from a boat acts substantially upwardly from said crown to effect anchor unsnagging.

* * * * *